US005275648A

United States Patent [19]

Cobett et al.

[11] Patent Number: 5,275,648

[45] Date of Patent: Jan. 4, 1994

[54] HEAT CURABLE ORGANIC RESIN FOUNDRY SAND BINDER COMPOSITION

[75] Inventors: Thomas A. Cobett, Strongville, Ohio; Neil W. Markham, Long Beach, Calif.; Ralf R. Teltschik, Schwarzenbruck, Fed. Rep. of Germany

[73] Assignees: Giesserei Verfahrens Technik Inc., Strongsville, Ohio; Giesserei Verfahrens Technik GmbH, Schwarzenbruck, Fed. Rep. of Germany

[21] Appl. No.: 2,079

[22] Filed: Jan. 8, 1993

Related U.S. Application Data

[63] Continuation-in-part of Ser. No. 883,882, May 12, 1992, abandoned, which is a continuation of Ser. No. 598,992, Oct. 17, 1990, abandoned.

[30] Foreign Application Priority Data

Oct. 20, 1989 [DE] Fed. Rep. of Germany ..... 3934940

[51] Int. Cl.[5] ..... B28B 7/34

[52] U.S. Cl. ..... 106/38.2; 106/38.35; 164/21; 164/527

[58] Field of Search ..... 106/38.2, 38.3, 38.35; 164/21, 526, 527; 523/139, 140

[56] References Cited

U.S. PATENT DOCUMENTS

| | | | |
|---|---|---|---|
| 2,878,539 | 3/1959 | Halpern | 22/193 |
| 3,070,991 | 1/1963 | Holbrook et al. | 106/38.2 |
| 3,428,110 | 2/1969 | Walker | 164/43 |
| 3,854,533 | 12/1974 | Gurley et al. | 166/276 |
| 4,076,869 | 2/1978 | Flynn | 427/430.1 |
| 4,252,592 | 2/1981 | Green | 427/189 |
| 4,271,214 | 6/1981 | Miki et al. | 427/345 |

*Primary Examiner*—Mark L. Bell
*Assistant Examiner*—Margaret Einsmann
*Attorney, Agent, or Firm*—Frank H. Foster

[57] ABSTRACT

A heat curable organic sand binder based upon epoxide or epoxide novolac resin and a latent dicyandiamide or imidazole curing agent, with or without an imidazole accelerator, which may be used as a direct replacement for other "Hot Box" and "Warm Box" foundry resin binders and as a direct replacement for other "Shell Sand" foundry resin binders.

12 Claims, No Drawings

HEAT CURABLE ORGANIC RESIN FOUNDRY SAND BINDER COMPOSITION

This is a continuation-in-part application of Ser. No. 07/883,882, filed May 12, 1992, now abandoned, which is a continuation of application Ser. No. 07/598,992, filed Oct. 17, 1990, now abandoned.

The invention concerns a foundry sand mixture composition useful in foundry hot-box, warm-box and shell coremaking and moldmaking, and more particularly relates to a foundry sand mixture composition consisting essentially of foundry sand and an epoxide resin or a blend of epoxide and epoxide novolac resins, mixed with a latent heat curable curing agent, with or without an accelerator, and curable by heat for the production of foundry sand molds and cores. It is common practice to refer to these heat curable resin binders as "Hot Box" or "Warm Box" binders since the core box or pattern must be heated to affect curing of the sand, resin, curing agent and accelerator mixture.

Since the Croning or "Shell" Process for making cores and molds was developed in Germany by Johannes Croning in the late 1930's, it has become one of the most widely used foundry sand binder processes. Even today, there are castings which can be made only with the Shell Process. Unfortunately, the Shell Process has changed very little since its development and there has never been a viable alternative to Croning's original Process.

In spite of numerous casting advantages obtained from the Shell Process, many foundries are being forced to replace it due to operating restrictions forced on them by regulatory agencies and concerned neighbors. The Shell Process uses a Phenol/Formaldehyde resin cured by heat in the presence of Hexamethylene Tetramine. The "Hexa" curing agent produces a strong, objectionable, ammonia odor which is difficult or impossible to control. The presence of Phenol and Formaldehyde cause health concerns to foundry workers and to water quality boards after the used sand is thrown away.

Some of the most significant advantages of the Shell Process are the excellent flowability of the dry sand mix and the ability to make a hollow core. These points make the Shell Process somewhat more desirable than the Hot-Box Process. Shell cores will have similar high handling strength and productivity as the Hot-Box cores.

Shell Process sand must be pre-coated with resin and curing agent. Many foundries do not have the equipment needed to coat the sand. Thus, they purchase the coated sand from a commercial coated sand supplier. Sand may be coated with the Warm Coating Process or the Hot Coating Process.

The current Warm Coating Process used a Phenolic resin dissolved in a solvent and a dry curing agent which may be dispersed in water. The ambient temperature sand is charged into a mixer and the resin/solvent blend is added. After a short mixing period, the curing agent is added and the solvent is removed from the sand mix by the heat of friction and by blowing warm air through the sand mixer. After discharge and screening, a dry, resin coated sand remains with the curing agent already in it.

The current Hot Coating Process uses a solid flake Phenolic resin and a dry curing agent which may be dispersed in water. The sand is pre-heated to 250°-300°

F. before it is charged into the mixer. The flake resin is added and then melted onto the sand. The curing agent is added with the water and sand is further cooled by blowing air through the sand mixer. After discharge, screening and further cooling, a dry resin coated sand remains with the curing agent already in it, without putting any solvents into the atmosphere.

In both Processes, the Phenolic resin is used at 1.0 to 5.0% by weight of the sand and the curing agent, Hexamethylene Tetramine, is used at 8.0 to 16.0% by weight of the resin.

The "Hot Box" and "Warm Box" processes utilize sand coated with a thermosetting resin in liquid form and a latent curing agent in liquid or dry powder form. This mixing of sand, resin and curing agent is done at ambient temperature. A metal pattern or core box is then heated to a temperature of 200 to 300 degrees C. and the damp mixture of sand, thermosetting resin binder and latent curing agent is applied to it by dropping or by fluidization with air. After a period of a few seconds to several minutes, the pattern or box is inverted or opened. The sand, resin and curing agent mix has now sufficiently hardened so that the mold or cure can be handled and stored for later use in the metal casting process. The "Warm Box" process operates at somewhat lower temperatures than the "Hot Box" process.

This type of process is widely used in the foundry industry to make metal castings of high dimensional tolerance. A disadvantage of the "Hot Box" or "Warm Box" process is that the preferred resins are Phenol/Formaldehyde, Urea/Formaldehyde or Furfuryl Alcohol/Formaldehyde or combinations thereof. Formaldehyde is considered to be a toxic material by nearly all industrial nations. There is also a pungent odor generated during the making of the core or mold as well as during metal pouring and shakeout. The problem of toxic materials and/or obnoxious odor exists with most current "Hot Box" and "Warm Box" processes.

It is desirable to have a resin binder system that can be used in a similar manner to the "Hot Box" or "Warm Box" processes without exhibiting obnoxious odors or containing toxic materials such as formaldehyde. It is further desirable that the said new resin binder process have the same physical strengths and performance benefits as the existing "Hot Box" and "Warm Box" resin binders, thereby allowing for the utilization of the new resin process with existing equipment and tooling.

Epoxide and epoxide novolac resins cured by dicyandiamide with or without an imidazole are used in the aerospace, automotive, electronic, coating and adhesive industries. The cured epoxides are inert, non-toxic polymers. They are not chemically reactive and remain as very stable compounds. There is no presence of formaldehyde or other toxic materials.

It has now been found that a heat curable sand, resin and curing agent mix can be produced utilizing an epoxide or epoxide novolac resin and a latent curing agent with or without an accelerator.

According to the present invention, there is provided a sand, resin, curing agent and accelerator composition comprising a medium to high molecular weight epoxide resin, an epoxide novolac resin, or, a mixture of the two, both preferably having an epoxide equivalent weight of 150 to 250; a latent heat curable curing agent such as dicyandiamide or an imidazole; and possibly an imidazole accelerator. Useful epoxide and epoxide novolac resins have an epoxide equivalent weight (E.E.W.) of 150 to 500 and may have an E.E.W. of about 150 to 1500. Certain imidazoles will affect the curing of epoxides without the presence of dicyandiamide. These mixtures will quickly harden when exposed to heat.

Accordingly, to produce a flowable sand, resin, curing agent and accelerator mix, it may be necessary to dilute or dissolve the resin, curing agent or accelerator in a solvent such as propylene carbonate, methylglycol, methoxypropanol, methyl lactate or butyl lactate. The resin/diluent solution is applied to the sand at 0.5 to 5.0 percent by weight of the sand. The heat curable latent curing agent and accelerator may be applied to the sand in liquid (with diluent) or powder form at 2.0 to 25.0 percent by weight of the resin. The resulting damp sand mixture is now ready for use by heating it to temperatures in excess of the curing agent and accelerator activation temperature.

In all cases, various accelerators can be used such as modified or unmodified imidazoles, including, but not limited to 2-methyl imidazole, 2-phenyl imidazole and 1-H-imidazole.

A particularly useful preparing of the foundry sand mixture employs a solid epoxide resin dissolved in an evaporatable solvent (such as acetone) to provide a resin solution which upon mixing with clean dry foundry sand and the latent heat curable curing agent in a manner adapted (e.g. with acetone, slight warming from ambient temperature up to about 135° F. (37° C.) or passing dry air or gas therethrough or thereover) to evaporate the evaporatable solvent and thus to provide foundry sand particles with a dry solid coating of the epoxide resin and the curing agent. The evaporated evaporatable solvent, when desired can be recovered and recycled by using conventional condensation and absorption means and other conventional techniques.

Another useful producing of the foundry sand mixture employs the epoxide resin as small solid flakes, granules or pellets and an adding and mixing of these solid resin pellets into clean dry foundry sand and latent heat curable curing agent with a heating of the sand and the curing agent and, while heating, cooling by air or gas fluidization, or by adding water in an amount and manner (e.g. by using a controlled amount of cooled air or gas in the fluidization, or by spraying water droplets in an amount effective to control the overall mix of sand and curing agent to a suitable temperature (i.e. about 212° F. (100° C.) ranging from minimizing to avoiding precuring of the epoxide resin) adapted to evaporate the water, and thus provide the foundry sand particles with a dry solid coating of the epoxide resin and curing agent.

In general, the produced foundry sand mixture is in an uncured to substantially uncured resin state and is flowable (e.g. pourable) and blowable (e.g. can be entrained or carried in an air or gas stream), and, upon curing to a cured state and employed in foundry shell coremaking and moldmaking has an adequate tensile strength sufficient and effective for use in coremaking and moldmaking (i.e. can be handled and used as a foundry core and mold customarily are with little to no unwanted breakage for foundry usages). In many instances, when employed in foundry coremaking and moldmaking, the foundry sand mixture composition in the cured state has a 24 hour tensile strength over 350 pounds per square inch. However, for some foundry applications considerably less tensile strengths in the cured state are useful (e.g. 60 to 100+ p.s.i.) and the foundry sand mixture composition in a cured state sufficiently meets and/or exceeds these lower requisite tensile strengths.

The following examples will serve to illustrate the invention.

EXAMPLE A

A sand mixture was prepared having the following composition by weight:

98.2% Silica Sand AFS Grain Fineness Number 90
1.5% Liquid Resin—
80% Dow DER 331 Epoxide Resin (E.E.W.) 187 to 193)
20% Propylene Carbonate Diluent
0.3% Powder Curing Agent—
100% Dicyandiamide The sand mixture was blown into an AFS Standard Tensile Strength Specimen Core Box which had been heated to 150 degrees C. The test core required 2 minutes of curing time after which it had sufficient strength to be removed from the core box. No odor or smoke were present during the curing cycle. The 24 hour tensile strength of the cured sand core was measured as being over 350 pounds per square inch (over 25 Newtons per square centimeter). The mixed sand was stable for over 1 week at room temperature with no loss of performance.

EXAMPLE B

A sand mixture was prepared having the following composition by weight:

98.2% Silica Sand AFS Grain Fineness Number 90
1.5% Liquid Resin—
40% Dow DER 331 Epoxide Resin
40% Dow DEN 431 Epoxide Novolac Resin
20% Propylene Carbonate Diluent
0.3% Powder Curing Agent—
100% Dicyandiamide The sand mixture was blown in to an AFS Standard Tensile Strength Specimen Core Box which had been heated to 150 degrees C. The test core required 1 minute of curing time after which it had sufficient strength to be removed from the core box. No odor or smoke were present during the curing cycle. The 24 hour tensile strength of the cured sand was measured as being over 350 pounds per square inch (over 25 Newtons per square centimeter). The mixed sad was stable for over 1 week at room temperature with no loss of performance.

EXAMPLE C

A sand mixture was prepared having the following composition by weight:

98.3% Silica Sand AFS Grain Fineness Number 90
1.5% Liquid Resin—
40% Dow DER 331 Epoxide Resin
40% Dow DEN 431 Epoxide Novolac Resin
20% Propylene Carbonate Diluent
0.3% Powder Curing Agent—
80% Dicyandiamide
20% 2-Methyl Imidazole The sand mixture was blown into an AFS Standard Tensile Strength Specimen Core Box which had been heated to 150 degrees C. The test core required only 30 seconds of curing time after which it had sufficient strength to be removed from the core box. No odor or smoke were present during the curing cycle. The 24 hour tensile strength of the cured sand was measured as being over 350 pounds per square inch (over 25 Newtons per square centimeter). The mixed sand was stable for over 8 hours at room temperature with no loss of performance.

EXAMPLE D

A sand mixture was prepared having the following composition by weight:

98.475% Silica Sand AFS Grain Fineness Number 90
1.5% Liquid Resin
40% Dow DER 331 Epoxide Resin
40% Dow DER 431 Epoxide Novolac Resin
20% Propylene Carbonate Diluent
0.075% 1-H-Imidazole The sand mixture was blown into an AFS Standard Tensile Strength Specimen Core Box which had been heated to 150 degrees C. The test core required only 15 seconds of curing time after which it had sufficient strength to be removed from the core box. No odor or smoke were present during the curing cycle. The 24 hour tensile strength of the cured sand was measured as being over 350 pounds per square inch (over 25 Newtons per square centimeter). The mixed sand was stable for over 8 hours at room temperature with no loss of performance.

EXAMPLE E

A Warm Coated epoxy resin sand mixture composition was prepared using the following materials:

500 lb. Dry Foundry Sand 70 AFS Grain Fineness
14 lb. Epoxy Resin Solution of
30.0% Acetone
10.0% Shell Chemical EPON 164 (Solid Epoxy Cresylic Novolac Resin, E.E.W. 200 to 240)
60.0% Shell Chemical EPON 2004 (Solid Epoxy Bisphenol A Resin, E.E.W. 875 to 975)
0.3 lb. Curing Agent of
60.0% dicyandiamide
20.0% 1-H Imidazole
20.0% 2-Methyl Imidazole The sand, resin solution and curing agent were mixed together at ambient temperature in a standard foundry sand mixer for about 6 minutes. Due to the evaporation of the acetone the mix became a dough mass and eventually broke into individual sand grains, each coated with a solid epoxy resin/curing agent mixture. Forced air was directed into the mixer to aid in the evaporation of the acetone. The dry resin coated sand mix was discharged onto a vibrating screen to remove any remaining lumps. The resulting epoxy resin coated sand was blown into an AFS Standard Tensile Strength Specimen Core Box which had been heated to 150° C. After 2 minutes of curing time, the test cores were broken and were shown to have over 100 p.s.i. Hot Tensile Strength. No odor or smoke were present during the curing cycle. The 1 hr. Cold Tensile Strength of the cured sand core was measured as being over 400 p.s.i. The mixed sand has proven to remain dry and flowable for more than 6 months with no loss in coremaking performance.

EXAMPLE F

A Hot Coated epoxy resin sand mixture composition was prepared using the following materials:

500 lb. Dry Foundry Sand 70 AFS Grain Fineness
10 lb. Solid Epoxy Resin Flakes of
15.0% Shell Chemical EPON 164 (Solid Epoxy Cresylic Novolac Resin, E.E.W. 200 to 240)
85.0% Shell Chemical EPON 2004 (Solid Epoxy Bisphenol A Resin, E.E.W. 875 to 975)
0.2 lb. Curing Agent of
60.0% Dicyandiamide
20.0% 1-H Imidazole
20.0% 2-Methyl Imidazole The sand was pre-heated to a temperature of 150° C. The heated sand and dry, solid resin were mixed together in a standard foundry sand mixer for about 2 minutes. The curing agent (dispersed in water) was then added and mixing continued for a total of 6 minutes. Due to the cooling from the evaporation of the water, the mix became a doughy mass and eventually broke into individual sand grains, each coated with a solid epoxy resin/curing agent mixture. Forced air was directed into the mixer to aid in the evaporation of the water and the cooling of the sand. The dry resin coated sand mix was discharged onto a vibrating screen to remove any remaining lumps.

The resulting epoxy resin coated sand was blown into an AFS Standard Tensile Strength Specimen Core Box which had been heated to 150° C. After 2 minutes of curing time, the test cores were broken and were shown to have over 100 p.s.i. Hot Tensile Strength. No odor or smoke were present during the curing cycle. The 1 hr. Cold Tensile Strength of the cured sand core was measured as being over 400 p.s.i. The mixed sand has proven to remain dry and flowable for more than 6 months with no loss in coremaking performance.

We claim:

1. A foundry sand mixture composition consisting of: 0.5 to 5.0% by weight of a latent heat curable epoxide resin, having an epoxide equivalent weight of about 150 to 1500, and 0.01 to 1.0% by weight of a latent heat curable curing agent, dry or diluted with a solvent and in admixture with a balance of a clean dry foundry sand; said composition characterized as useful in foundry hot box, warm-box and shell coremaking and moldmaking and in an uncured state as flowable and blowable and in a cured state as a core or a mold as having a tensile strength sufficient for use as a foundry core or mold.

2. A foundry sand mixture composition according to claim 1 wherein the latent heat curable epoxide resin and the latent heat curable curing agent are dry.

3. The foundry sand mixture composition of claim 1 in the form of particles of the clean dry foundry sand having thereon a dry solid coating consisting of the epoxide resin and the curing agent.

4. A foundry sand mixture composition according to claim 1 wherein the epoxide resin is an epoxide novolac resin or a blend of epoxide resin and epoxide novolac resin.

5. A foundry sand mixture composition according to claim 4 wherein the epoxide resin or the blend of epoxide resin and epoxide novolac resin is diluted with the solvent which is propylene carbonate, methylglycol, methoxypropanol, methyl lactate or butyl lactate.

6. The foundry sand mixture composition of claim 4 employing the epoxide resin which is a solid resin diluted with an evaporatable solvent to provide a resin solution which upon mixing with the clean dry foundry sand and the latent heat curable curing agent in a manner adapted to evaporate the evaporatable solvent provides the foundry sand with a dry solid coating of the epoxide resin and the curing agent.

7. The foundry sand mixture composition of claim 4 employing the epoxide resin which is a solid resin and as a dry solid resin upon adding and mixing with the clean dry foundry sand and curing agent while both are heated and, while heated, are cooled by fluidization with air, or by addition of water in an amount and manner adapted to evaporate, provides the foundry sand with a dry solid coating of the epoxide resin and the curing agent.

8. A foundry sand mixture composition consisting of:

0.5 to 5% by weight of a latent heat curable epoxide resin, which resin is an epoxide novolac resin or a blend of epoxide resin and epoxide novolac resin, having an epoxide equivalent weight of about 150 to 1500, and 0.01 to 1.0% by weight of a latent heat curable curing agent, diluted with a solvent, which solvent is propylene carbonate; and in admixture with a balance of a clean dry foundry sand;

said composition characterized as useful in foundry hot box coremaking and moldmaking.

9. A foundry sand mixture composition according to claim 8 wherein the latent heat curable curing agent is 2-Methyl Imidazole or 1-H-Imidazole.

10. A foundry sand mixture composition according to claim 8 wherein the latent heat curable curing agent is 1-H-Imidazole.

11. A foundry sand mixture composition according to claim 8 wherein the latent heat curable curing agent is Dicyandiamide.

12. A foundry sand mixture composition according to claim 11 wherein the latent heat curable curing agent of Dicyandiamide is accelerated by including an Imidazole.

* * * * *